United States Patent [19]

Naveh

[11] Patent Number: 5,029,374

[45] Date of Patent: Jul. 9, 1991

[54] LOOM REED DRAWING-IN MACHINE

[75] Inventor: Nathan Naveh, Petah-Tikva, Israel

[73] Assignee: Hunter Associates Laboratory, Inc., Reston, Va.

[21] Appl. No.: 337,328

[22] Filed: Apr. 13, 1989

[51] Int. Cl.[5] ..... D03J 1/14; D03J 1/00

[52] U.S. Cl. ..... 28/204; 28/203; 28/201

[58] Field of Search ..... 28/204, 203, 201

[56] References Cited

U.S. PATENT DOCUMENTS

| | | | |
|---|---|---|---|
| 363,689 | 5/1987 | Sherman | 28/204 |
| 871,680 | 11/1907 | Field et al. | 28/204 |
| 915,336 | 3/1909 | Côté et al. . | |
| 1,589,587 | 6/1926 | Colman . | |
| 2,445,999 | 7/1948 | Drake | 28/204 |
| 2,707,317 | 5/1955 | Mackay . | |
| 2,807,861 | 10/1957 | Wieneke . | |
| 3,444,601 | 5/1969 | Wieneke . | |
| 3,787,938 | 1/1974 | Crandall et al. | 28/204 |
| 3,867,745 | 2/1975 | Crandall et al. | 28/204 |
| 4,215,455 | 8/1980 | Patel . | |

FOREIGN PATENT DOCUMENTS

| | | | |
|---|---|---|---|
| 12304 | 6/1880 | Fed. Rep. of Germany . | |
| 86015 | 12/1920 | Switzerland . | |
| 1352332 | 2/1970 | United Kingdom | 28/204 |
| 2117419 | 10/1983 | United Kingdom . | |

OTHER PUBLICATIONS

Knotex, "Spare Parts Catalog", Warp Reeding Machine, RSIH Plus.

European Search Report—Jul. 7, 1990.

*Primary Examiner*—Werner H. Schroeder

*Assistant Examiner*—Bibhu Mohanty

*Attorney, Agent, or Firm*—Burns, Doane, Swecker & Mathis

[57] ABSTRACT

A small portable drawing-in machine is disclosed for suspension on the top of a loom reed and for movement along the lengths of the reed. A drive screw on the machine meshes with the reed dents to control the position of the machine on the reed, and a threading hook is projectable through the spaces between reed dents to draw warp yarns therethrough. A set of drive screws of different pitches may be replaceably mounted in the machine to give the machine a capability for use on reeds of different pitch.

The threading hook is reciprocably mounted on a rotatable turntable that is coupled through suitable gearing to the drive for the drive screw so that a machine cycle includes a movement of the threading hook to carry a warp yarn through a space between reed dents, a rotary movement through 360° of the turntable to disengage the warp yarn from the hook, continues with a rotary movement of the drive screw sufficient to advance the drawing-in machine one step along the reed, and ends with a movement of the hook in the opposite direction through an adjacent space between reed dents to position it for receiving another warp thread.

22 Claims, 9 Drawing Sheets

Fig. 25
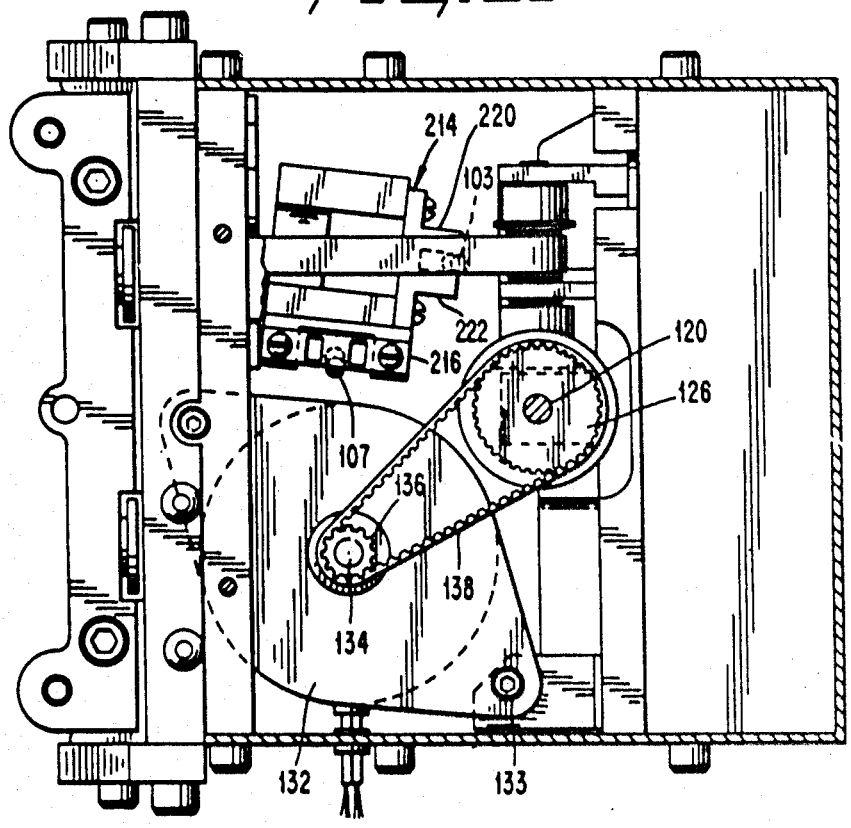
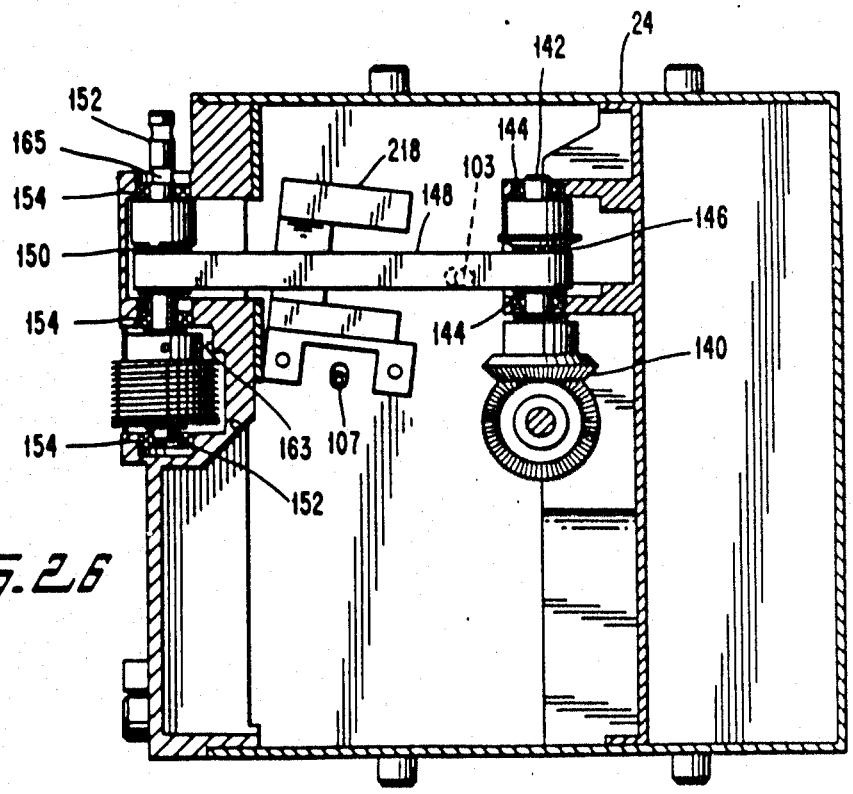
Fig. 26

LOOM REED DRAWING-IN MACHINECL FIELD OF THE INVENTION

This invention is concerned with the threading of large numbers of yarns through side by side, closely spaced, openings such as the spaces between the dents of the reeds of looms. It relates to methods and apparatus for facilitating such threading or drawing-in operations sometimes referred to as "reeding".

BACKGROUND

In an ordinary loom setup, hundreds of warp yarns or threads pass from a supply into the weaving zone in side-by-side parallel relationship to one another. Each of the yarns passes through some shedding means such as a heddle eye, and during each cycle of loom operation, some of the warp yarns are displaced from others by the shedding means so as to form what is known as a "shed" through which one or more weft yarns may be inserted in a transverse direction.

A loom reed is interposed between the warp yarn shedding means and the place where the weft yarn is inserted. This reed extends across the entire width of the loom and is made up of a large number of thin vertical strips called "dents" regularly spaced apart from one another so as to leave spaces through which the warp yarns may pass without being prevented from making the vertical movements required in the formation of the shed. After a weft yarn has been inserted in a shed in front of the reed, the reed is moved forwardly to shift the inserted weft thread and accomplish a beatup action so as to position the new weft thread at the fell of the cloth being woven.

This sequence of operations is repeated over and over again as more and more weft threads are inserted and beaten up into the newly formed fabric.

It is crucial to quality weaving that the warp yarns be properly oriented with respect to the reed. Each warp yarn must occupy its proper space between selected reed dents, and the structure must be such that the warp threads are not damaged as a result of relative movements between such yarns and the reed parts. Moreover, the front edges of the reed dents must cooperate properly with the newly inserted weft threads in order to accomplish satisfactory beatup operations that will not lead to appearance defects (e.g. lines) in the woven fabric.

The one-by-one threading of the warp yarns through the spaces between the dents of the reed is an operation which is referred to as "drawing-in" or "reeding". It must be carried out whenever the particular loom is to be changed over to the production of a new fabric having a different thread setup, such for example, as different arrangements of warp thread colors and/or sizes and/or materials. The demands of fashion tend to increase the number of occasions for such changeovers.

Drawing-in operations also may be necessitated by accidents (e.g., "smash" events) which break or damage large numbers of the warp yarns. For instance, a misaligned shuttle may be lead to rupture of many of the warp threads. When this occurs, weaving cannot be resumed until the damaged warp threads have been again threaded through the proper spaces between the dents of the reed and newly tied into the fabric being woven.

Drawing-in operations can be carried out entirely by hand. For fine fabrics, such operations can be very tedious indeed, and mistakes lead to much lost weaving capacity. Yet, hand operations were the only practically available ones prior to the present invention for addressing situations which required drawing-in without removing the reed from the loom or otherwise disturbing the loom setup.

U.S. Pat. No. 2,707,317 proposes a drawing-in machine adapted to be clamped on top of a loom reed and having rails along which certain of the components may be moved in an effort to position them for reed threading operations. The disclosed construction utilizes a camming action derived from the threading instrumentality itself as motive force for stepwise movements intended to position the parts properly for successive threading operations. This approach is considered inadequate from a practical standpoint and incapable of yielding the precise control that is necessary in reed drawing-in operations.

There are available large machines to which a reed (separated from the loom) may be brought for reeding. Some of these have been proposed also for movement into positions adjacent looms, so that the loom reeds might be associated therewith and subjected to drawing-in by the mechanisms of the reeding machine.

These large machines are cumbersome to use and do not offer the flexibility often needed in weaving mills. Substantial amounts of setup time ordinarily are required in connection with their use. Moreover, problems have been experienced with regard to the maintenance of perfect registry between the drawing-in elements of these machines and the spaces between the reed dents. Typically, the drawing-in elements are moved in stepwise fashion across the reed, stopping in front of each dent-to-dent space to draw a warp yarn through such space. However, slight errors in the length of the advancing movement of the drawing-in elements tend to be cumulative as the elements move through the hundreds of cycles ordinarily required for threading a reed, so that occasions may arise when the threading instrumentalities or elements are not properly oriented with respect to a space between adjacent reed dents. On such occasions, there are risks of damage to reed parts and/or yarns as well as risk of improper threading of the reed.

OBJECTS AND SUMMARY OF THE INVENTION

An object of the present invention is to overcome various of the disadvantages associated with methods and apparatus for drawing-in prior to the present invention.

Another object of the invention is to provide a method of drawing-in wherein a small portable machine is removably attached to the reed of a loom in such a manner that its threading instrumentality is conveniently accessible to a machine operator.

A further object of the present invention is to provide a portable drawing-in machine that can be supported entirely on, and ride along, a loom reed whether the reed is in its ordinary position on a loom or displaced from such position, the machine being capable of maintaining a proper orientation with respect to the dents of the reed at all times and functioning reliably to thread each of the warp yarns through the intended space between adjacent reed dents.

Another object of the invention is to provide a drawing-in machine which can be supported on a loom reed with a minimum expenditure of setup time and operated in a semi-automatic manner to carry out cycles of reed threading operations under the control of a machine operator.

Yet another object of the invention is to provide a new method and apparatus for maintaining perfect registry between the threading instrumentalities of a drawing-in machine and the dents of the reed.

A further object of the invention is to provide a drawing-in machine with new apparatus for simply and reliably producing and coordinating the movements required for threading the reed, for pulling the newly threaded warp yarn ends to free them from the threading instrumentalities, and for advancing the threading instrumentalities with respect to the width of the reed in between threading movements.

A preferred drawing-in machine in accordance with the invention is a small device which may be hung on the top of a loom reed and which may travel stepwise across the width of the reed. Power for operating the drawing-in machine may be supplied from a battery or other source of electricity located on the mill floor or at some other convenient position near the loom being threaded. An ordinary cable can be provided to connect the power supply with a small motor in the drawing-in machine.

The new drawing-in machine may be used to thread a reed without regard to the position of the reed. The reed can be in its normal position on the loom or it can be raised above the loom for draw-in. Indeed, the reed can be removed entirely from the loom and taken to another location if desired.

The drawing-in machine includes a drive screw having a multiple turn helical thread the pitch of which is the same as the pitch of the reed to be threaded. The axis of the drive screw extends parallel to the width of the reed, and the screw thread is exposed on the side of the drawing-in machine which faces the reed dents so that portions of the screw thread may enter the spaces between adjacent dents. With a large number of screw threads engaged with spaces between reed dents, registry between the drawing-in machine and the reed is assured at all times. Unintended movements of the drawing-in machine with respect to the reed ar virtually impossible.

The desired stepwise movements of the drawing-in machine across the width of the reed are accomplished by turning the drive screw about its axis. A turn of exactly one revolution will cause the drawing-in machine to move bodily along the reed a distance exactly equal to the pitch of the reed.

For most of its length, the drive screw thread is uniform in its cross-section. However, the trailing turn of the thread is widened in a rearward direction to exert a camming action on the reed dent located just behind the drive screw. This dent is bent rearwardly so that the space between it and the dent just in front of it is enlarged to receive a threading finger carried by the drawing-in machine. This finger makes an excursion through the space to accomplish a warp yarn threading result. The controlled bending of this reed dent does not result in damage. Yet perfect threading is assured.

In a preferred form of the invention, the threading finger has a yarn engaging hook portion at its active end that is projected through and withdrawn from a dent-to-dent space in the reed to thread a loop portion of yarn therethrough. After being withdrawn from the reed, the hook portion is given a swinging movement through a circular path to pull the just threaded yarn loop away from the reed and free it from engagement with the hook, so that the hook will be conditioned properly for the next drawing-in cycle when it has completed a movement through the circular path.

BRIEF DESCRIPTION OF THE DRAWINGS

A more complete understanding of these and other objects advantages and features of the present invention will be gained from a consideration of the following detailed description of a preferred embodiment illustrated in the accompanying drawings, in which:

FIG. 25 is a horizontal cross-sectional view of the drawing-in machine of FIG. 1 taken at a level below the top of the housing and looking down on the internal components;

FIG. 26 also is a horizontal cross-sectional view through the drawing-in machine of the present invention, but some parts have been omitted and the level of the view has been chosen to illustrate clearly the coupling between the drives for the screw and for the threading finger of the machine;

DETAILED DESCRIPTION OF PREFERRED EMBODIMENT

Figure 1:
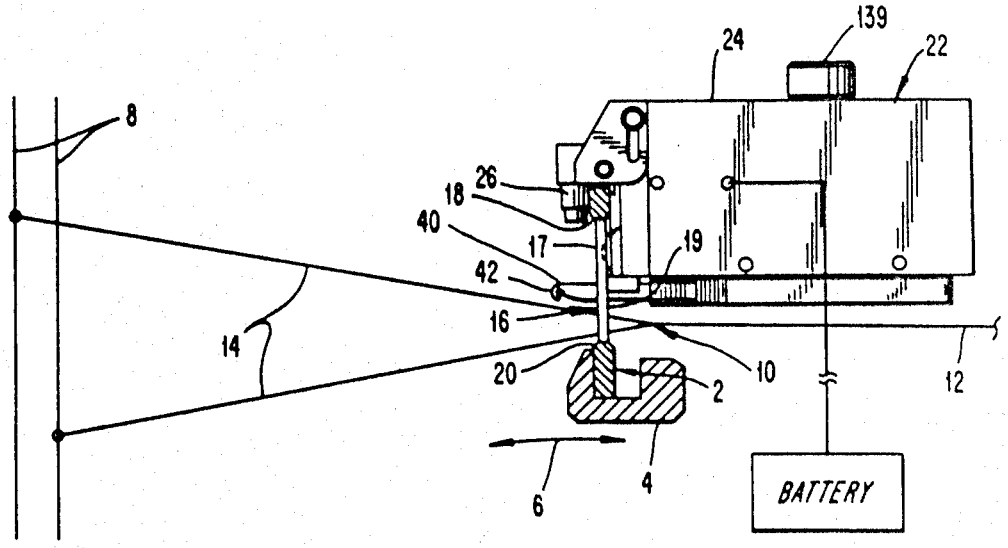
FIG. 1 is a diagrammatic elevational view in a lengthwise (i.e. warpwise) direction of components of a loom, showing the loom reed in cross-section and illustrating a drawing-in machine of the invention in place thereon.
Figure 2:
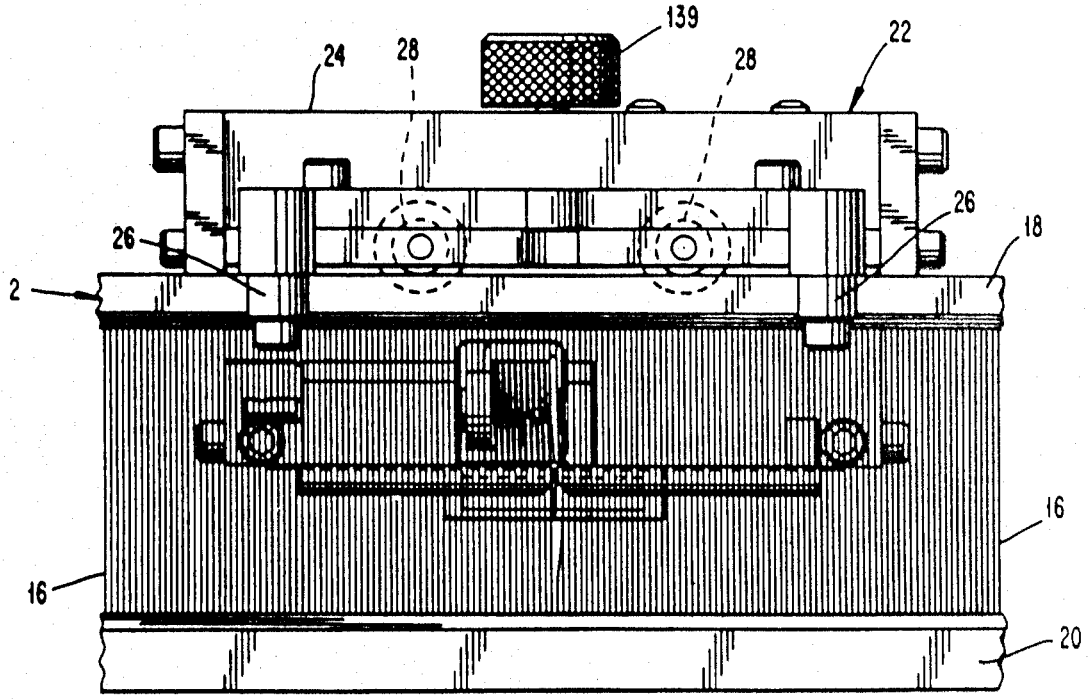
FIG. 2 is a rear elevational view of the loom reed of FIG. 1 with the drawing-in machine in operative position thereon.

For orientation purposes, FIG. 1 shows a loom reed 2 fixed on top of a lay 4 which is oscillated back and forth as indicated at 6 in the space between the loom heddles 8 and the fell 10 of the cloth 12 being woven. Warp threads or yarns 14 are moved up and down by the heddles 8 to form a shed through which a weft yarn or thread may be inserted. This weft insertion operation takes place in front of the loom reed 2 (to the right of the reed 2 as viewed in FIG. 1).

The reed 2 is made up of a large number of thin vertical members 16 called "dents" which are uniformly spaced apart from one another across the entire width of the weaving zone of the loom and held in place by top and bottom structures 18 and 20. When the reed has been properly threaded for weaving, one or more of the warp yarns 14 normally will pass through each of the spaces between the side faces 17 of adjacent dents 16 of the reed. As the reed moves back and forth, irregularities in the reed dents may adversely affect the warp yarns 14 which must pass through the narrow spaces between adjacent dents.

A weft insertion operation will take place at a time when the movement 6 of the lay 4 has positioned the reed 2 rearwardly of the location shown in FIG. 1. After the weft insertion, the front edges 19 of the reed dents 16 will contact the inserted weft thread or threads during forward movement of the lay 4 to drive the weft into the fell 10 of the cloth being woven. This is a "beatup" operation which is important with respect to the uniformity of the cloth being woven. Irregularities in shape or positioning of the front edge portions of the reed dents which contact the weft threads tend to produce irregularities in the cloth.

The present invention has to do with methods and apparatus for drawing-in the warp yarns 14 with respect to the spaces between the dents 16 of the reed of the loom in preparation for weaving operations. The illustrated drawing-in machine 22 is designed to simplify these warp yarn threading operations at the loom reed and permit them to be carried out efficiently without damage to the reed and without requiring removal of the reed 2 from the lay 4 of the loom.

Although the invention will be described with particular reference to drawing-in warp yarns while the reed 2 is in its normal position on the loom, it should be understood that the drawing-in machine also can be used with a reed raised above its normal position and specially supported there for reed threading. Also, the reed to be threaded might be removed entirely from the loom location for threading if desired.

The drawing-in machine 22 is a portable device of small size which can be suspended on the top 18 of the reed 2 when it is desired to carry out drawing-in operations. For example, the machine 22 might have overall dimensions on the order of ten by ten by fifteen centimeters and a weight on the order of 1300 grams.

The main body of the machine housing 24 will be located in use in front of the reed 2 and it is provided with adjustably positioned rollers 26 for engaging the rear vertical face of the top 18 of the reed as well as vertically adjustable rollers 28 for riding along the upper surface of the top 18 of the reed 2.

Figure 3:
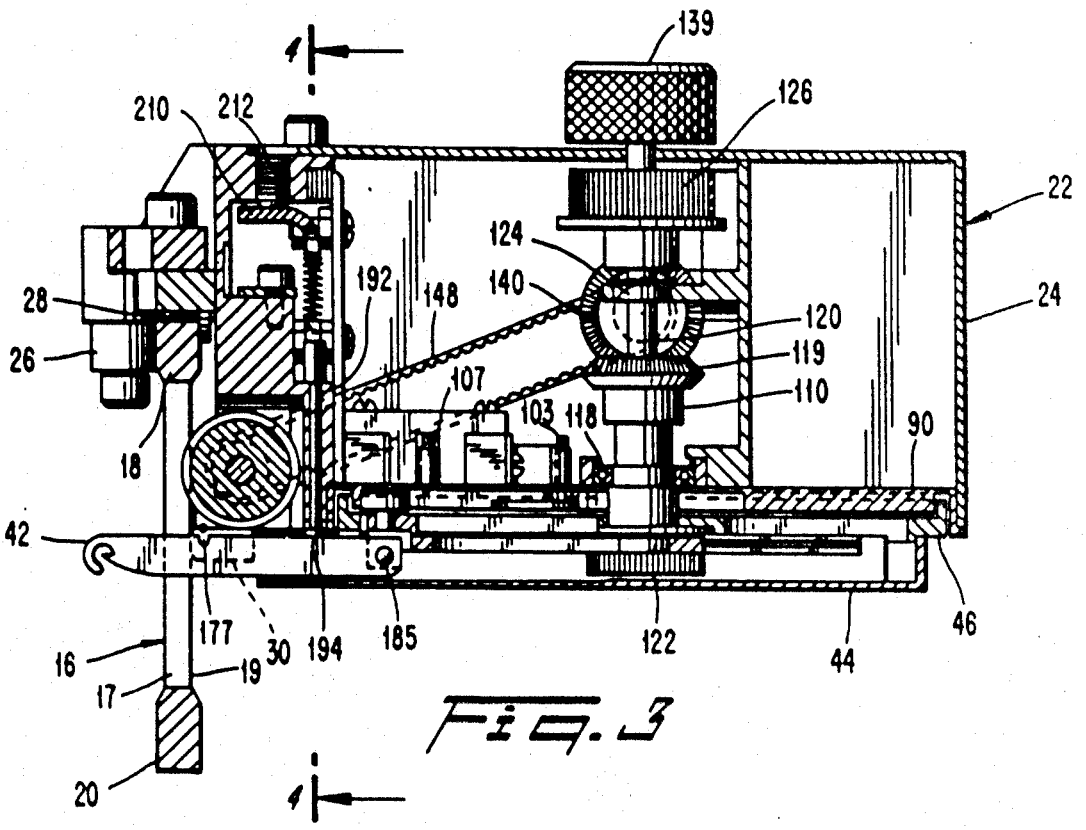
FIG. 3 is a longitudinal cross-sectional view showing in elevation certain of the parts of the drawing-in machine and depicting relationships between the loom reed and the drawing-in machine components.
Figure 23:
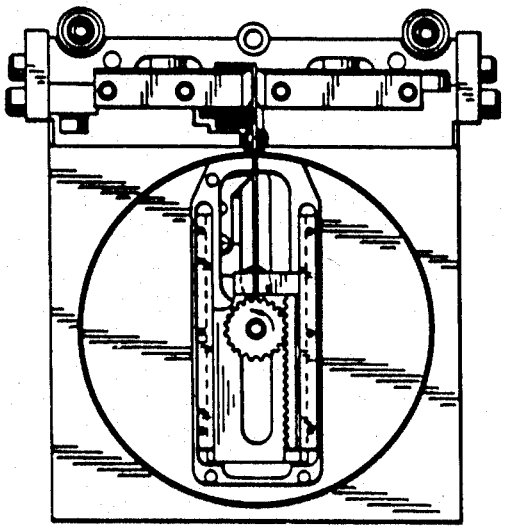
FIGS. 17 and 18, 19 and 20, 21 and 22, and 23 and 24 are pairs of horizontal cross-sectional views looking up from different levels at portions of the threading finger drive mechanism at different portions of the machine cycle.

In this preferred embodiment, the machine 22 is provided with another area of contact with the reed through plastic contact members 30 mounted at the bottom of the housing 24 in position to contact the front edges 19 of the reed dents 16. (FIGS. 3 and 23). In all, the arrangement is one in which the mounting of the drawing-in machine 22 on the reed 2 can be accomplished quickly and easily.

The support rollers 26 and 28 for the drawing-in machine are not power driven and they do not supply the motive force for moving the machine 22 lengthwise of the reed 2. Rather, the machine 22 is driven lengthwise of the reed 2 by means of a drive screw or wheel 32 shown best in FIGS. 5-9.

This drive screw 32 has a helical thread 34 which extends for multiple turns about the axis of the screw and which is substantially uniform in transverse cross-section throughout most of its length. In this main body portion of the thread, the width of the thread 34 is less than the space between adjacent dents 16. The ratio of the widths of a thread and the adjacent space between thread turns may be on the order of forty to sixty in a preferred embodiment of the invention. In this respect, it should be understood that the drawings are diagrammatic to some extent. The trailing end portion 36 of the thread is wider than the remainder of the thread, for a purpose to be described more fully below. The pitch (i.e., turns per unit of screw length) of the main body of the thread 34 is chosen to be the same as the pitch (i.e., dents per unit of reed length) of the reed 2 on which the particular drive screw 32 is to be used.

Figure 8:
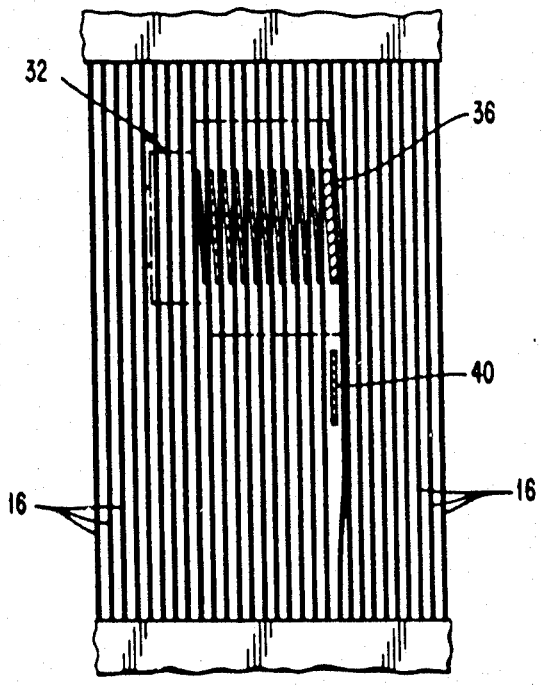
FIG. 8 is an enlarged rear elevational view of a loom reed with portions of the thread of the drive screw of the drawing-in machine cooperating therewith.
Figure 9:
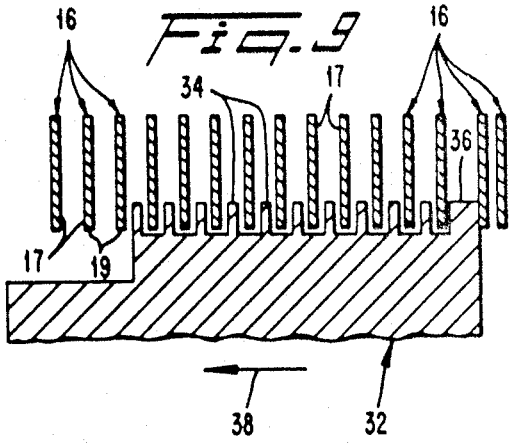
FIG. 9 is an enlarged horizontal cross-sectional view showing from a different angle the cooperative relationship between the drive screw threads and the dents of the loom reed.
Figure 5:
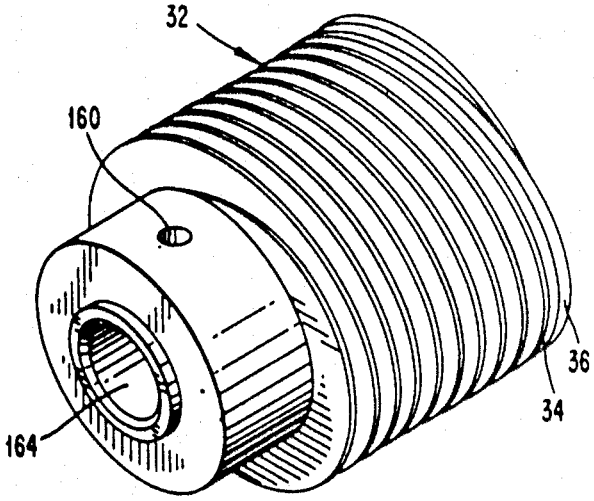
FIG. 5 is a diagrammatic perspective view of a drive screw component of the drawing-in machine which cooperates with the reed to effect movement of the drawing-in machine along the length of the reed.
Figure 6:
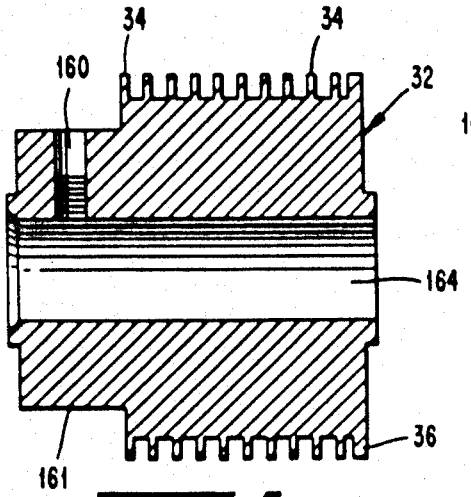
FIG. 6 is an axial cross-sectional view of the drive screw component of FIG. 5.
Figure 7:
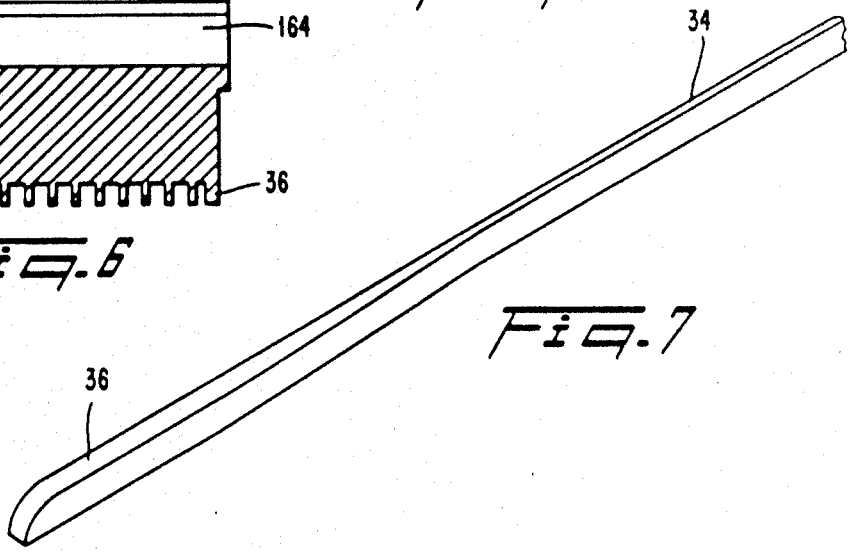
FIG. 7 is a diagrammatic view depicting in layout form a widening of the thread of the drive screw of FIG. 5 in the last (i.e., trailing) turn of the screw.

The drive screw 32 is mounted on the housing 24 of the machine 22 so that its thread will be exposed and in position to contact the reed dents 16. When the machine 22 is brought into position on a reed 2, the location of the machine 22 lengthwise of the reed 2 may be shifted slightly to cause the projecting edge portions of the thread 34 of the drive screw to enter the spaces between adjacent reed dents 16 as best indicated in FIGS. 3, 8 and 9. Because of the angle of the helical thread 34, a portion of the thread which projects into a reed space may span substantially the space between the reed dent side faces 17 which bound such space with a small amount of play or looseness in the fit of these parts being preferred. The fact that the screw 32 presents a number of turns of the main thread 34 simultaneously to the reed 2 assures that variations in dent-to-dent spacing in the particular reed being threaded will not lead to improper operations. Fine dents particularly are thin and easily bent, so that some variations are virtually inevitable. However, these are removed for practical purposes when a substantial number of screw turns enter the dent-to-dent spaces at the same time.

Moreover, the co-action between the dents and projecting portions of multiple turns of the helical thread stabilizes the position of the machine 22 on the reed 2 when the screw 32 is held against rotation. Impacts on the machine 22 which might otherwise cause undesired movements of the machine along the reed 2 are readily resisted through reactions spread over many dents so that no permanent deformation or other damage is likely to occur.

When the drive screw 32 is rotated about its axis, portions of the screw thread 34 will press against adjacent portions of the reed dents 16 to move the machine 22 lengthwise of the reed 2 as indicated by the arrow 38 in FIG. 9. The screw is rotated one full revolution during each cycle of operations of the drawing-in machine 22 to effect a lengthwise shifting of the drawing-in machine in the direction 38 along the loom reed 2 by a distance equal to the sum of the thickness of one reed dent 16 and the width of one space between adjacent reed dents.

This full rotation of the drive screw 32 takes place during only a portion of the machine cycle. During the remaining portion of the machine cycle the machine 22 does not move bodily with respect to the reed 2. However, a threading finger 40 carried by the machine is actuated at this time. Its rear end portion is in the form of a thread engaging hook 42. The finger 40 is disposed directly beneath the widened trailing end portion 36 of the thread of the drive screw 32 (as shown in FIG. 8).

The finger 40 is movable bodily from a forward position in which its hook portion 42 is entirely in front (to the right in FIG. 1) of the reed 2 rearwardly through a space between adjacent reed dents 16 to a rear position (FIGS. 1 and 3) in which its hook portion 42 is located well to the rear of the reed 2. When the finger 40 is in this rearmost position, a machine operator will engage a warp yarn with the hook portion 42 and initiate a drawing-in cycle.

In the course of the cycle, the engaged warp yarn will be pulled to the right in FIGS. 1 and 3 to thread it through the space between a pair of dents 16 of the reed 2. After the withdrawing of the threading finger 40 has been completed, the drive screw 32 will be rotated for one complete revolution to advance the whole machine 22 bodily along the reed 2 so that the threading finger 40 will be in an alignment with the next space between adjacent reed dents 16. Then, the threading finger 40 will again be projected rearwardly, passing through such space to its rearmost position where it will be ready for receiving another warp yarn.

This cycle is illustrated diagrammatically in FIGS. 10–15. These views look up at the bottom of the drawing in machine 22 show a cover 44 within which a reciprocable carrier for the threading finger 40 is movable back and forth to project the hook portion 42 of the threading finger 40 rearwardly when appropriate, and then to withdraw it in a forwardly direction after a warp thread has been associated therewith. The carrier cover 44 is mounted upon a turntable 46 mounted at the bottom of the housing 24 of the drawing-in machine for rotation about a generally vertical axis parallel to the vertical front face of the reed 2.

Figure 10:
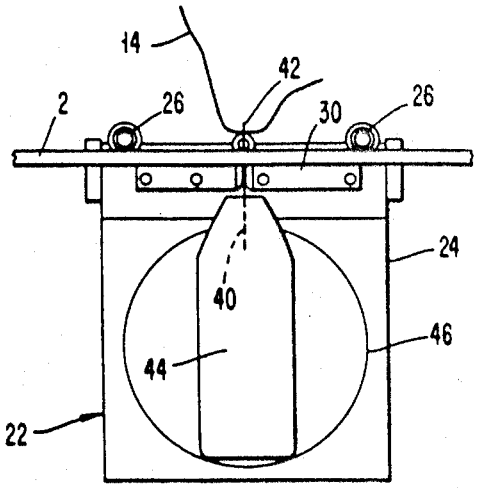

FIG. 10 represents the positions of the various parts at a time between drawing-in cycles. At this time the parts are stationary with respect to one another, and the threading finger has been projected to its rearmost position in which the body of the finger passes through a space between adjacent reed dents and the hook portion 42 of the threading finger is in position to be engaged by a warp yarn.

A drawing-in cycle is initiated in accordance with the present invention by exerting tension on a warp thread 14 engaged with the hook portion 42 of the drawing-in finger 40. As the operator pulls up on the warp thread, the threading finger 40 moves upwardly a short distance to trip a switch to begin the cycle.

Figure 11:
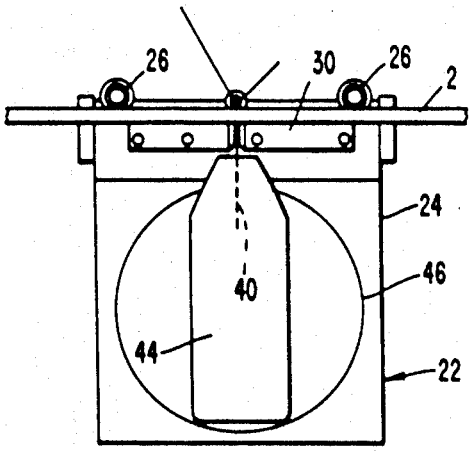

The first action that takes place is a withdrawal of the threading finger 40 toward the front of the loom. This is indicated in FIG. 11. The turntable 46 is stationary, as is the drive screw 32 for the drawing-in machine. Hence, there is no change at all in the alignment of the threading finger 40 as it is withdrawn forwardly through the space between adjacent reed dents. This withdrawal movement causes the hook portion 42 of the threading finger 40 to thread a loop of the warp yarn 14 through the space between the adjacent reed dents. The forward movement of the threading finger 40 continues until the hook portion 42 thereof brings the warp yarn 14 into proximity to the leading edge of the carrier cover 44. At this point, some frictional forces are exerted upon the warp yarn 14 by the actions of the adjacent surfaces of the hook portion 42 of the threading finger 40 and the carrier cover 44, but the warp yarn 14 is not firmly clamped in place with respect to these parts.

Figure 12:
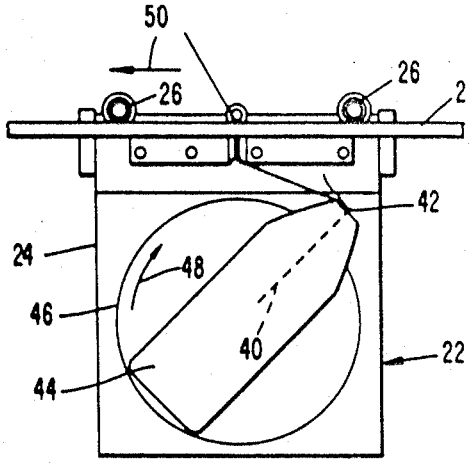
Figure 13:
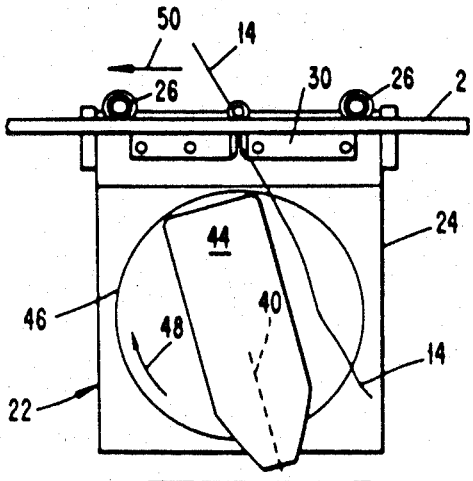

As soon as the withdrawal motion of the threading finger 40 has been completed, the turntable 46 begins to rotate in a clockwise direction as indicated at 48 in FIG. 12, swinging the hook portion 42 away from the reed 2 to carry the warp yarn 14 well beyond the zone of the reed so that it may be more readily accessible to a machine operator. During this time the drive screw 32 also is rotated to cause movement of the drawing-in machine 22 bodily to the left in FIG. 12 as indicated by the direction arrow 50.

As the rotation of the turntable 46 continues, the hook portion 42 moves through a circular path, pulling the engaged portion of the yarn away from the reed until the tension in the yarn increases sufficiently to slide the yarn end portion relative to the hook. If the circular path is not adequate in itself to pull the end of the warp yarn 14 free from contact with the hook 42 to complete the drawing-in of this warp yarn with respect to the reed, the desired action will nevertheless take place because an intermediate portion of the yarn will wrap around the cover 44 as the hook 42 swings from its most remote position back toward the end of its circular path. The rotation of the turntable 46 will complete a single revolution, and the bodily movement 50 of the drawing-in machine 22 to the left in FIG. 13 will continue for the same period of time to displace the machine 22 a total distance equal to the sum of a dent thickness plus a dent-to-dent spacing width.

Figure 14:
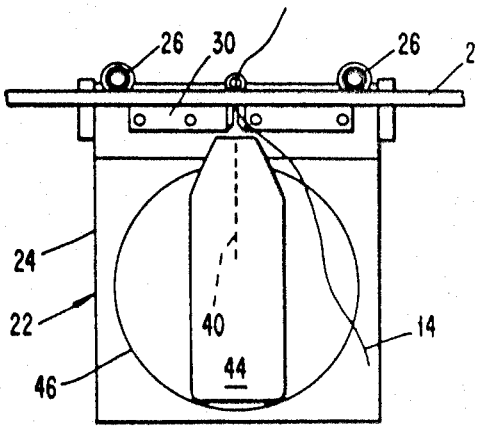
Figure 16:
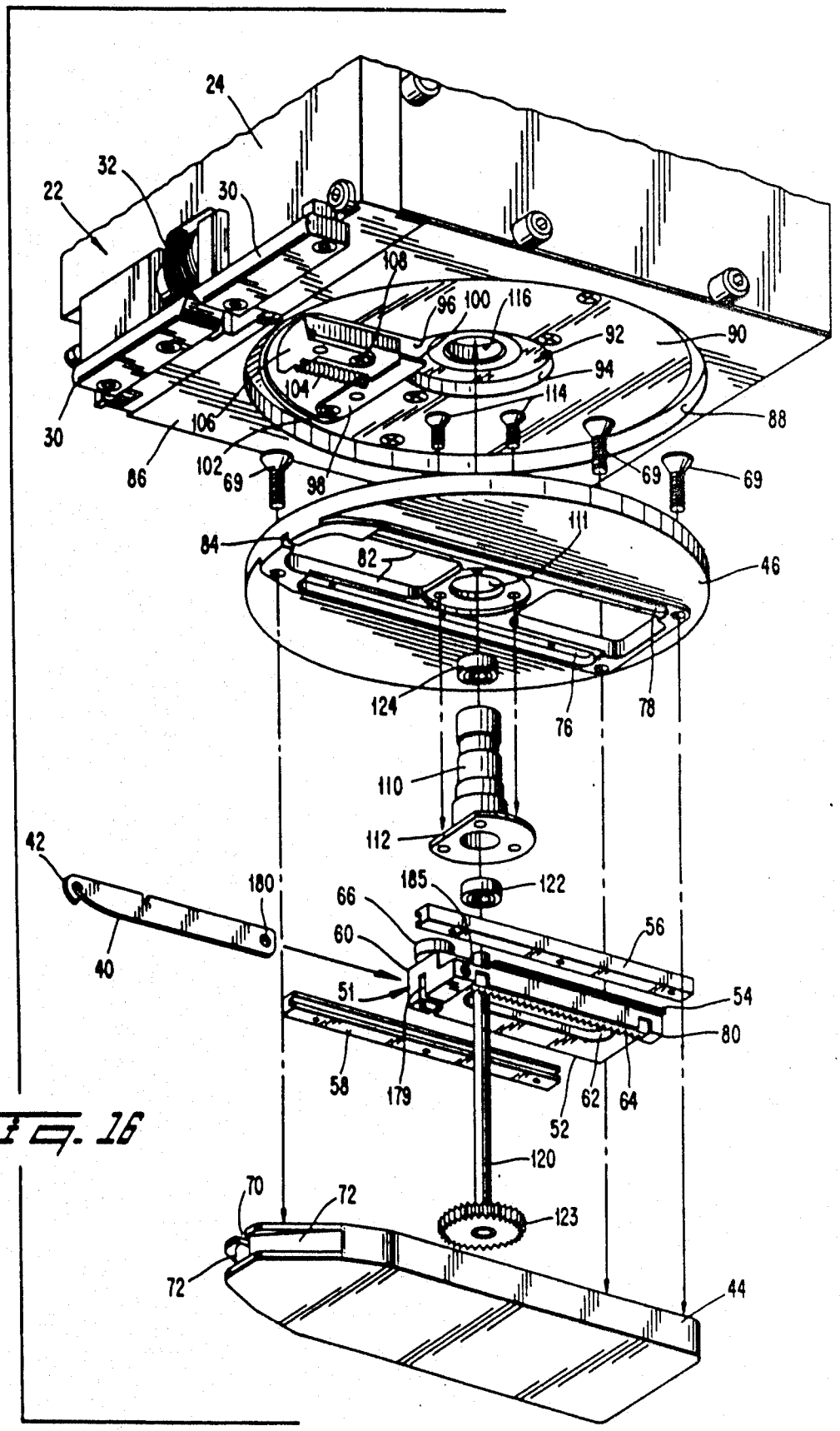
FIG. 16 is an exploded perspective view, also looking from the bottom of the drawing-in machine, which depicts components that cooperate to give the threading finger the desired movements during operation of the drawing-in machine.

Rotation of both the drive screw 32 and the turntable 46 will cease when the turntable 46 reaches the position shown in FIG. 14. In this position, the axis of the threading finger 40 will be aligned with the reed dent space adjacent the one through which the previous warp thread 14 had been threaded.

Figure 15:
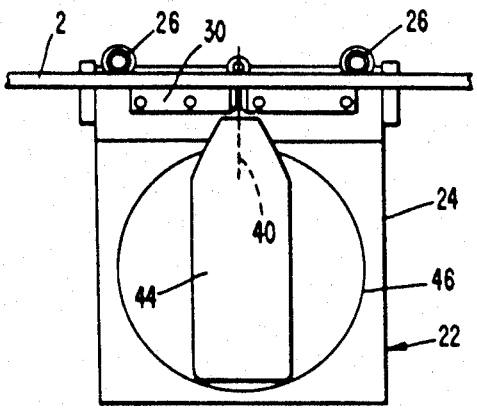
FIGS. 10–15 provide a series of diagrammatic views looking up at the bottom of the drawing-in machine of FIG. 1 as mounted on the loom reed, for illustrating a complete cycle of movements for the threading finger as it operates to draw a warp thread through the space between adjacent dents of a reed.

Immediately after the turntable 46 has reached the position shown in FIG. 14, the rearward movement of the threading finger 40 will be commenced to project it rearwardly through the reed into a position where another warp yarn may be engaged with the hook portion 42 thereof. This is indicated in FIG. 15. When the threading finger 40 has reached its rearmost position, the power is shut off, and no further movement of the parts will take place until a new cycle is initiated by the drawing-in machine operator.

A preferred form of reciprocating carrier 51 for giving the threading finger 40 its desired back and forth movements is illustrated in FIGS. 16, 17, 19, 21 and 23. Carrier 51 includes a body 52 having rails 54 extending longitudinally along its opposite edges. The rails 54 are received for sliding movement in tracks 56 and 58 mounted on the turntable 46. A head portion 60 of the carrier 51 is provided with means for releasably securing the threading finger 40 to the carrier, a preferred construction for the releasable connection being illustrated in greater detail in FIG. 28.

The central portion of the body 52 of the carrier 51 is cut away to provide an elongated slot 62 which receives a drive shaft 120. Along one margin of the slot 62 the carrier 51 is provided with a rack 64 having teeth which can engage with a drive gear 123 on an end portion of the shaft which extends through the slot 62.

At the top or back side of the head 60 of the carrier 51 there is a control element 66 which preferably is in the form of a roller freely rotatable on a pin or shaft 68 fixed with respect to the body 52 of the carrier 51. As will be explained below, this control element 66 coacts with control surfaces provided by the walls of a downwardly facing recess in a wall which is fixed in relation to the bottom body 24 of the drawing-in machine 22.

The carrier cover 44 fits over the carrier 51 and is attached to the turntable 46 by screw means 69. A slot 70 in the front or nose of the cover 44 permits the threading finger 40 to extend outwardly from the cover 44 and be projected through the space between adjacent reed dents in the manner described above. Adjacent the slot 70 the cover 44 preferably is provided with yarn guide surfaces 72 configured so that the cooperation between these surfaces and the hook portion 42 of the threading finger 40 can apply yielding restraining forces to a warp thread which has been pulled through the reed by the hook portion 42. In this connection, it should be understood that the hook portion 42 is preferably withdrawn into a position in which the warp yarn is in frictional contact with at least one of the surfaces 72 but not pinched or held fixedly with respect thereto.

The turntable 46 has a lower face which is provided with recesses 76 and 78 which receive the tracks 56 and 58 in which the rails 54 of the reciprocable carrier body 52 slide. These tracks 56 and 58 are releasably affixed to the turntable 46.

The turntable 46 also is provided with an aperture 82 of elongated configuration into which an upwardly protruding portion (FIG. 16) of the head 60 of the reciprocating carriage 51 may protrude. The overall thickness of the turntable 46 is such that the guide roller 66 mounted on the head 60 of the carriage 51 extends well above the upper face of the turntable 46 so that it may cooperate with guide surfaces on a downwardly facing member carried by the bottom of the housing 24 of the drawing-in machine 22.

A notch 84 on the lower face of the turntable 46 is located in alignment with the threading finger 40. This permits the threading finger to be moved upwardly a short distance under pressure provided by the operator of the machine through tensioning of a yarn which has been engaged in the hook portion 42 at the end of the threading finger 40. Means to be described later respond to such upward movements to provide control signals useful in initiating cycles of operation of the drawing-in machine.

The bottom 86 of the housing 24 of the drawing-in machine is provided with a circular recess 88 for receiving the turntable 46 and a wall 90 which is in turn recessed at 92 to provide guide surfaces 94 and 96 for cooperation with the control roller element 66 on the reciprocable carriage 51. The guide surfaces 96 form a slot extending generally radially from a cylindrical recess which provides the guide surface 94, as shown in FIGS. 16, 18, 20, 22 and 24. As will be explained more fully below, the roller 66 moves around the cylindrical wall 94 and moves radially out and in the slot formed by the walls 96 during each machine cycle.

A control element or finger 98 is pivoted at 102 to the bottom of the machine housing 24. It has an end surface 100 projecting into the path of the guide roller 66. This finger carries an upwardly extending rod or pin 103 which serves to activate a switching function and which will be described in greater detail below with reference to FIGS. 3, 25 and 26. A spring 104 urges the control element 98 to the position shown in FIGS. 16, 18, 20 and 24, but the control element 98 may be moved to the position shown in FIG. 22.

The other end of the spring 104 acts to bias a switching element or finger 106, pivoted to the bottom of the machine housing 24 at 108, into a position such that its end portion adjacent the end of the slot formed by the walls 96 will be contacted by the roller 66 when the latter moves to the end of the slot. This switching finger 106 also carries an upwardly extending rod or pin 107 for activating a switching function. It will be described in greater detail below with reference to FIGS. 3, 25 and 26.

Sleeve means 110 extends upwardly through a central opening 111 in the turntable 46 and carries a flange 112 fixedly to its lower end. The flange 112 may be secured to the turntable 46 by screw means 114. Above the turntable 46 the sleeve means 110 passes through a central opening 116 in recess 92 in the member 90 at the bottom of the housing 24. In the interior of the housing 24, the sleeve means 110 is received within bearing means 118 and has a bevel gear 119 fixed to its upper end. Thus it will be seen that the sleeve means 110 constitutes an outer shaft by which rotary movements of the turntable 46 are communicated to the bevel gear 119. As will be explained more fully below, the bevel gear 119 is relied upon as a drive input for the drive screw 32 which gives the drawing-in machine 22 its bodily movement lengthwise of the reed 2.

An inner shaft 120 extends both above and below the sleeve means 110. A bearing 122 is mounted inside the sleeve means 110 and serves as a bearing for the lower end portion of the shaft 120. At its lower end the shaft 120 has press fitted thereon a hub which is press fitted in a gear 123 in position to engage at all times with the rack 64 on the reciprocating carrier 51. The hub projects into the groove 62 of the reciprocating carrier 51 for the threading finger 40 and serves to stop the slide 51 on the way up and down to prevent side pressure on the roller 66 when it reaches the top and bottom of the radial groove 96.

After extending upwardly through the openings in the turntable and the bottom of the housing 24 of the machine, the shaft 120 is received within bearing means 124 and is fixed to a timing gear 126 by which rotary movements may be imparted to the shaft 120 (FIG. 3).

Particular reference now will be made to FIGS. 17-24 in explaining how the components cooperate during a machine cycle to produce the desired movements for the turntable 46 and the threading finger 40.

Figure 17:
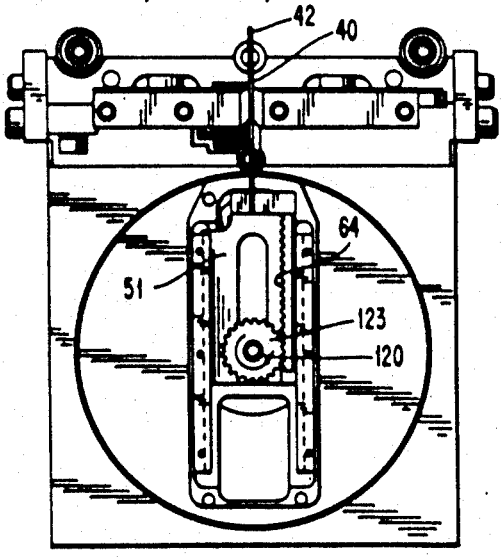
Figure 18:
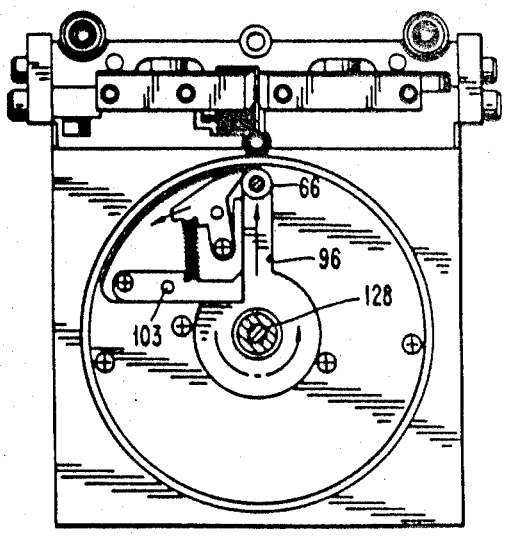

In the time interval between cycles of operation of the drawing-in machine, the control element or roller 66 on the threading finger carrier 51 will be located at the outer end of the radial slot 96 in the stationary member at the bottom of the machine housing 24. FIGS. 17 and 18 illustrate the parts as they appear an instant before reaching this position. When the position has been reached, all the movements stop until a new cycle is initiated by the machine operator.

As a new cycle begins, the timing gear 126 will be rotated in a direction to move the gear 123 at the bottom of the drive shaft 120 in a clockwise direction as viewed in FIGS. 17 to 24. With the control element 66 being located at the remote end of the slot 96, the carrier 51 will be locked against rotary motion, so that it will necessarily be moved linearly as the rotating gear 123 engages the rack 64 on the carrier. This will cause a withdrawing motion of the threading finger 40, and the control element 66 will move inwardly along the slot 96 in the stationary wall 90 at the bottom of the housing 24. This movement will continue until the control element 66 has reached the position indicated in FIGS. 19 and 20.

Figure 19:
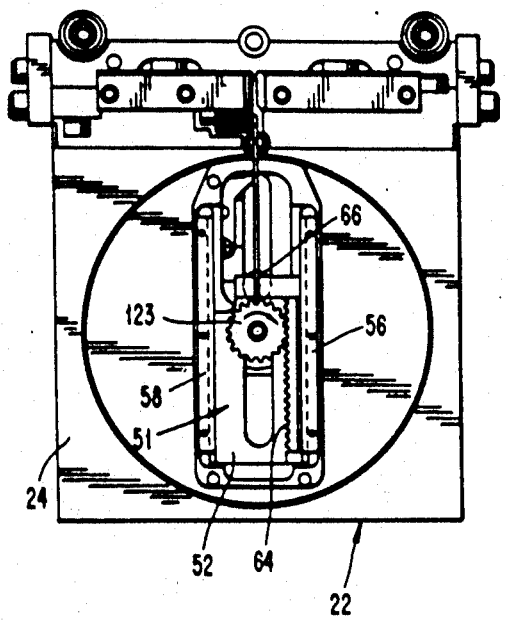
Figure 20:
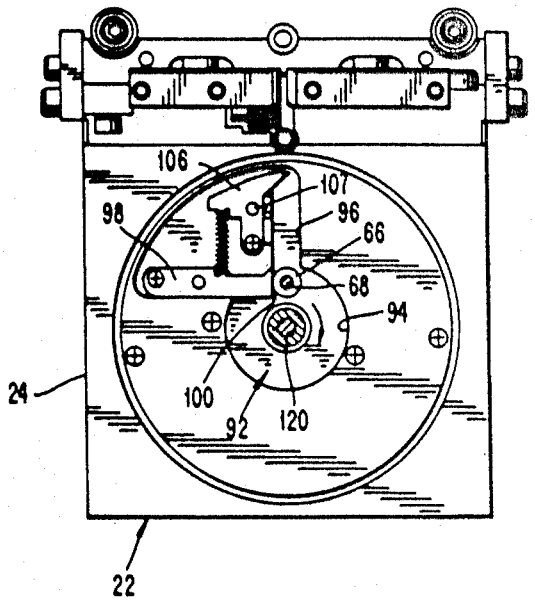

After the carrier 51 has moved far enough to position the control element 66 as illustrated in FIGS. 19 and 20, the element 66 will no longer be constrained within the radial slot 96 which held it against bodily movement about the axis of the shaft 120. Upon further rotation of the gear 123 in a clockwise direction as viewed in FIGS. 19 and 20, the carrier 51 will rotate. The coaction between the protruding rear portion of the head 60 of the carrier with the slot 82 in the turntable 46 will cause the turntable 46 to rotate with the carrier 51 during this time period. Since the sleeve means 110 is secured to the turntable 46, it also will rotate in a clockwise direction as the control element 66 swings around the cylindrical control surface 94.

Figure 21:
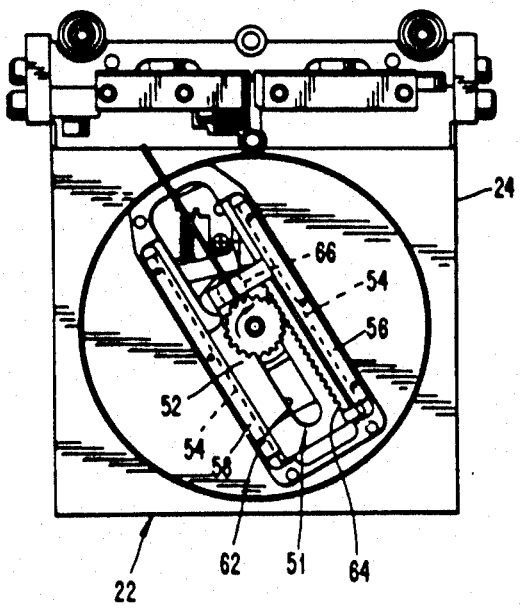
Figure 22:
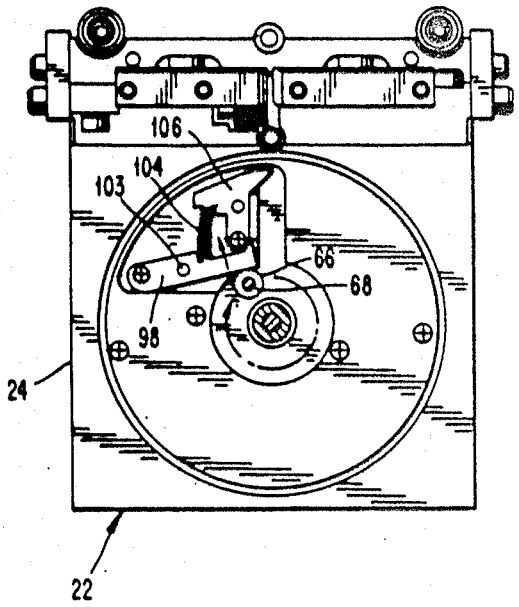

Continued movement of the control element 66 about the axis of shaft 120 will bring it into a position such that it will lift the control element or finger 98 in the manner indicated in FIGS. 21 and 22. The finger 98 must move in order to allow the control roller 66 to pass the end 100 of the element 98. After the control roller 66 has moved past the end 100 of the finger 98, the spring 104 will move the element 98 about its pivot toward its original position. Such movement swings the rod 103 about the pivot axis and causes actuation of an electrical switching function which reverses the direction of rotation of the electric motor which drives the timing gear 126, such reversal occurring at the moment when the control element 66 has again become aligned with the radial slot 96 in the stationary member at the bottom of the housing 24 as shown in FIG. 24.

Figure 24:
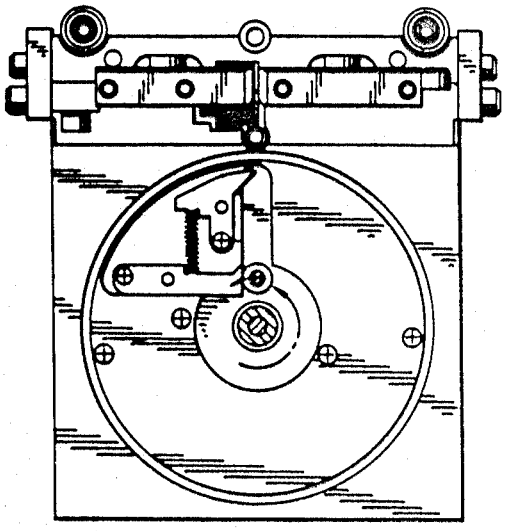

When the direction of rotation of the shaft 120 is reversed to a counterclockwise direction as viewed in FIG. 24, bodily movement of the control roller 66 in a counter-clockwise direction around the cylindrical wall 94 of the recess 92 in the stationary wall member 90 is prevented by the abutment surface 100 on the end of the control finger 98. However, the carrier 51 is free to move linearly toward the top of FIGS. 23 and 24 because the control roller 66 is aligned with the radial slot portion 96 of the recess in the stationary member 90. Hence, the gear 123 on the shaft 120 moves the rack 64 on the carrier 51 as indicated in FIG. 23. This movement will continue until, as indicated in FIGS. 17 and 18, the control roller 66 contacts the switch finger 106 and moves it to cause the pin or rod 107 to actuate a switching function that serves to stop the drive motor of the machine.

Thus, the cycle of machine operation ends with both the threading finger 40 and the turntable 46 at rest. In this position the threading finger 40 will be at its rearmost position with the hook portion 42 thereof in position to receive a warp yarn to be threaded through the reed 2.

The motor for driving the shaft 120 is designated in FIG. 25 by the reference numeral 132. This preferably is a direct current stepping motor of a well known type which permits precise control over the angular position of the motor output shaft 134. The motor is capable of turning a certain amount in one direction, abruptly reversing its direction and stopping without overshoot.

The motor housing may be releasably connected to the housing 24 of the machine 22 to position the motor at a convenient location in the upper portion of the housing 24. The motor shaft 134 carries a timing gear 136 which cooperates with a timing belt 138 to drive the timing gear 126 on the shaft 120.

During a cycle of machine operation, the motor 132 first rotates the shaft 120 in a clockwise direction as viewed from the bottom of the machine through one and one-half revolutions (540 degrees). Then the motor 132 reverses to produce one-half of a revolution of the shaft 120 (180 degrees). It will be understood that the first half revolution of the shaft 120 causes the linear withdrawal of the threading finger 40, the next revolution of the shaft 120 causes a complete rotation of the turntable 46, and the one-half revolution of the shaft 120 in the opposite or reverse direction causes the threading finger 40 to be projected to its rearmost position.

The shaft 120 also has fixed thereto a knob 139 which is located at the top of the drawing-in machine in a convenient position for turning manipulation by the machine operator. This permits the machine to be operated manually when desired to facilitate positioning of the machine, clearance of yarn irregularities, etc.

The power train for the drive screw 32 is such that the drive screw 32 rotates only when the turntable 46 rotates. The bevel gear 119 at the top of the sleeve means 110 fixed to the turntable 46 meshes with a bevel gear 140 on a horizontal shaft 142 carried by bearing means 144 mounted on the machine housing 24.

Figure 27:
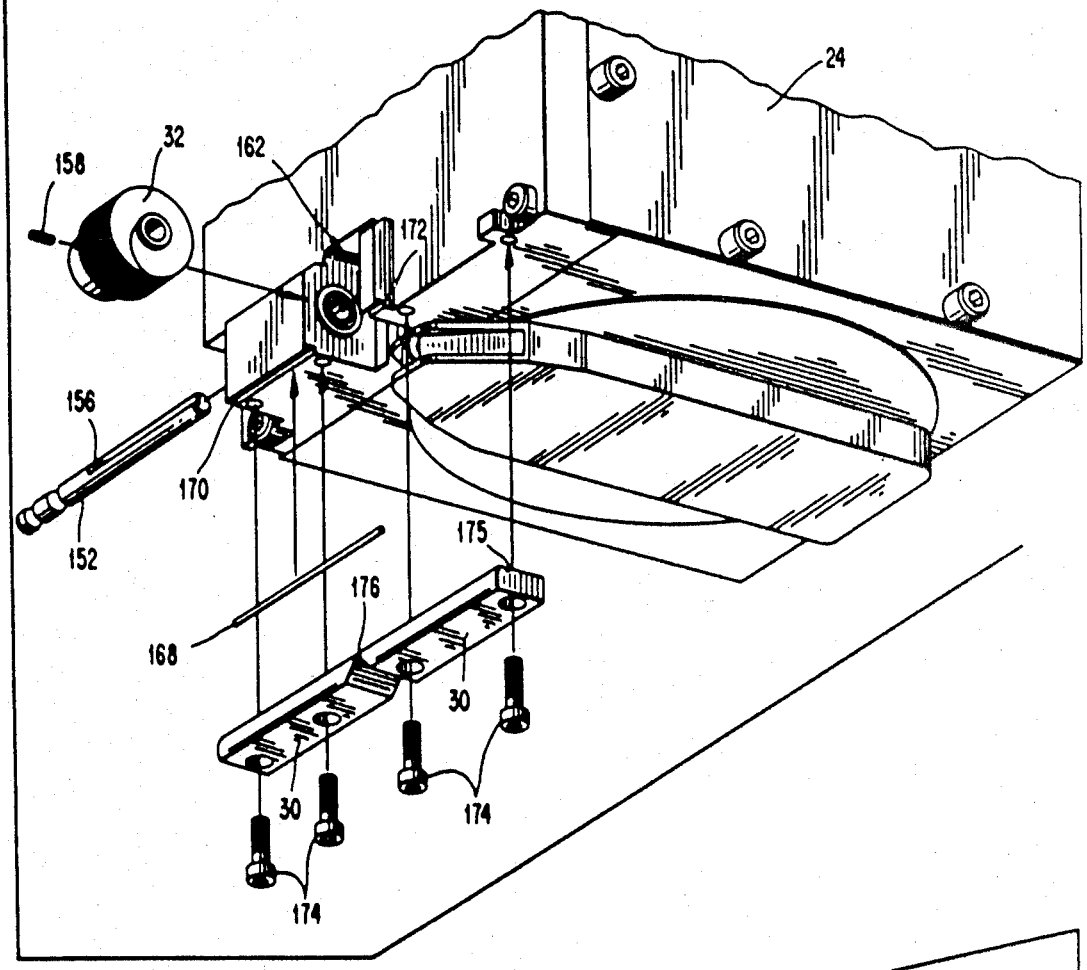
FIG. 27 is an exploded bottom view in perspective, illustrating the means employed for replaceably mounting a drive screw component in the drawing-in machine.

A central portion of the horizontal shaft 142 has a timing gear 146 fixed thereon for driving a timing belt 148 which encircles a timing gear 150 on a screw shaft 152 (FIG. 26) received in bearings 154 carried by the housing 24 of the machine. As shown in FIG. 27, the shaft 152 is provided with an elongated keyway 156, and keying means are provided for fixing the angular position of the timing gear 150 with respect to the shaft 152.

The keyway 156 in the shaft 152 also receives the projecting inner end portion of a detent screw 158 which may be threadedly connected to the wall of a radial opening 160 through a hub portion 161 at one end of the drive screw 32.

As is suggested by the exploded perspective view of FIG. 27 the mounting for the drive screw 32 is such as to permit easy replacement thereof. The drawing-in machine of the present invention can be adapted for use with reeds of different pitches, and replaceability of the drive screw 32 with another of a different pitch is an important feature from a practical standpoint.

The opening 162 in the rear face of the machine housing 24 for receiving the drive screw 32 has ledge means 163 which serves to give the opening as a whole a directional orientation for preventing insertion of a drive screw 32 which is not oriented properly. Note that the threaded portion of the drive screw is too big (FIG. 26) to be received in the part of the opening 162 where the ledge means 163 is located. Hence, the drive screw will fit in the opening only when the end of the drive screw 32 having the boss 161 thereon is located to the left in FIG. 27.

The shaft 152 is axially movable in the bearings 154 so that it may be shifted to the left in FIG. 27, entirely removing it from the axial bore 164 in the drive screw 32. This permits replacement of the drive screw 32 with another one of different pitch when this becomes desirable. Friction between the shaft 152 and the bearings 154 may be sufficient to prevent unintended linear movements of the shaft 152, but such forces need not be relied upon in all instances. Means can be provided for cooperating with one or more grooves 165 in the end portion of the shaft 152 to hold it releasably in place. One such system is a spring pressed ball (such as that illustrated for another purpose in FIG. 28) arranged to be urged into contact with the groove 165.

In considering that the apparatus in accordance with the present invention includes a set of drive screws 32 of different pitches, it is useful to note the thickness of a drive screw thread 34 may be greater in the case of a screw having fewer turns per unit of length. This correlates with the usual practice of using reed dents of greater thickness in reeds having fewer dents per unit of length; in an ordinary case the thickness of a dent will be about the same as the width of the space between dents.

The thicker dents used in reeds having lower dent densities are capable of absorbing greater forces without suffering injury, so that fewer of them need to be contacted by the helical thread of a drive screw 32 in order to distribute the reaction forces that may arise when the arrangement of the invention is employed. In all instances however, it is contemplated that at least several turns of the helical thread 34 will project into the spaces between adjacent reed dents to distribute the forces properly to assure trouble free operation. The number of thread turns in position to engage the side faces 17 of the dents preferably is at least ten, with twenty or more being even more preferable in reeds having higher pitches such as fifty or more dents per inch. In particularly preferred embodiments intended for use with fine reeds, thirty or forty turns of thread 34 may protrude into the dent-to-dent spaces.

The present invention takes advantage of these relationships in that the lengths of the body portions of a number of different drive screws 32 to be supplied with the basic machine 22 may have substantially the same lengths. That is, the overall dimensions of the body and hub portions of a drive screw for a reed having eighty dents per inch may be substantially the same as a drive screw for a reed having forty dents per inch. This permits any one of the set of drive screws to be installed readily in the opening 162 in the machine housing 24 with its hub portion in proper position relative to the ledge means 163.

In the preferred form of the invention illustrated in the drawings, a small guide bar 168 extends across the bottom of the opening 162 for receiving the drive screw 32. This guide bar 168 is received within slots 170 and 172 at the opposite margins of the opening 162 and is held in place by a clamping action exerted thereon by screw means 174 which hold the plastic contact elements 30 in place at the bottom of the machine housing. The upper surfaces of the contact elements 130 preferably are provided with grooves 175 to facilitate holding the guide bar 168 in place.

The guide bar 168 provides valuable protection against the possibility that a warp yarn 14 or stray fibers might become enmeshed in the threads on the drive screw 32. It will be understood in this connection that the threading finger 40 is located directly below the space 176 between the two contact elements 30, so that as a warp yarn is withdrawn through the reed toward the nose portion of the carrier cover 44, the yarn is apt to pass along the sloped surfaces 178 on the contact elements 30, and when this happens, the bar 168 stops inward movement of the yarn toward the threads of the drive screw 32. The upper edge of the threading finger 40 preferably has a notch 177 therein in position to receive the bar 168 as the threading finger 40 is pivoted upwardly by the machine operator after a warp yarn has been engaged by its hook portion 42.

Figure 28:
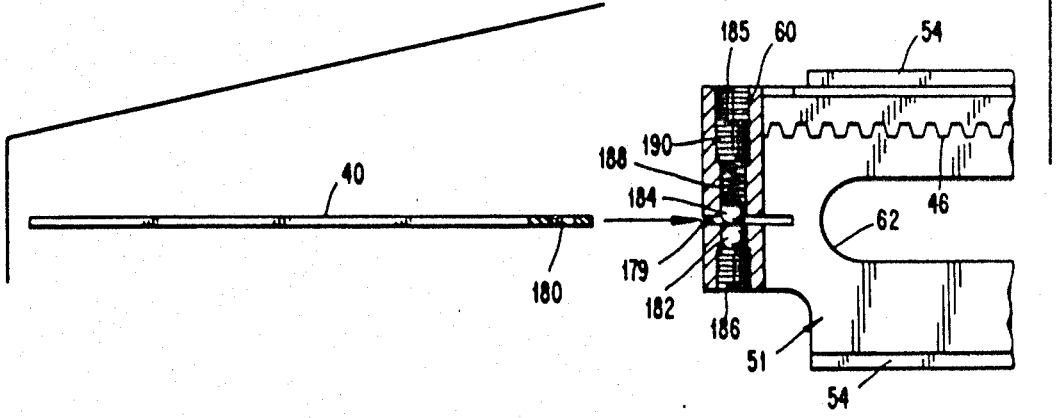
FIG. 28 is a detailed horizontal view illustrating the releasable attachment of the threading finger to its drive system in the drawing-in machine of FIG. 1.

Referring now to FIG. 28, there will be described means for releasably securing the threading finger 40 to the reciprocable carrier 51 of the machine. The head 60 of the carrier 51 is provided with a slot 179 for receiving the end of the threading finger 40 remote from the threading hook portion 42 thereof. This inner end portion of the threading finger 40 has a hole 180 therethrough which is brought into alignment with a bore 185 extending through the head 60 of the carrier 51.

A pair of balls 182 and 184 are disposed in the bore 185 to contact the threading finger 40 at the location of the hole 180. One of the balls 182 is held against outward movement in the bore 185 by a threaded plug 186. The other ball 184 is spring pressed toward the ball 182 by a spring 188 bearing against another threaded plug 190 in the bore 185.

Figure 4:
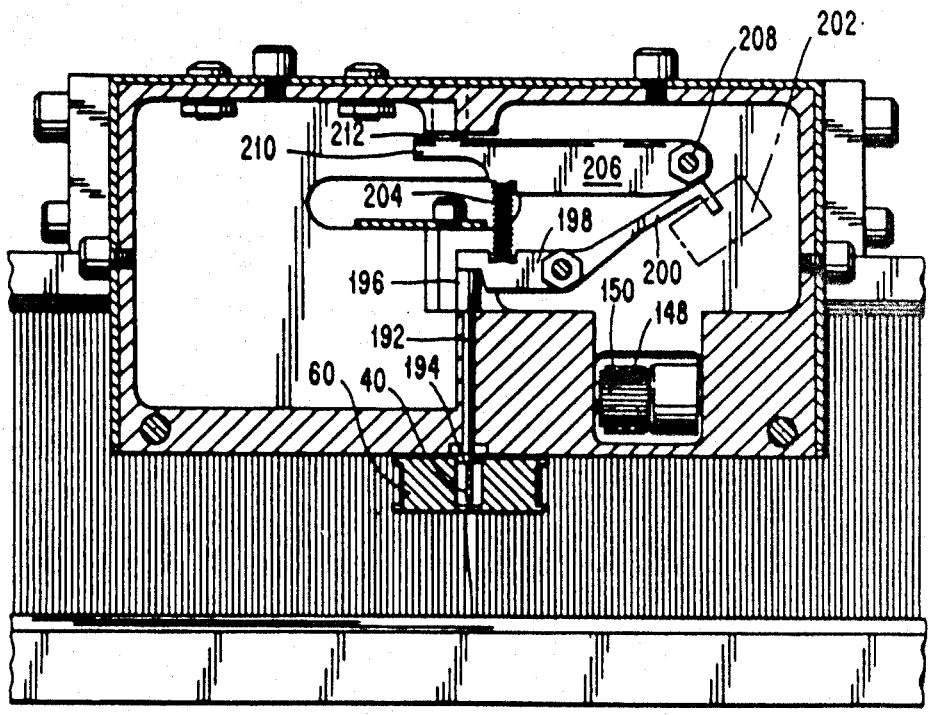
FIG. 4 is a transverse vertical cross-sectional view taken along the line 4—4 in FIG. 3.

At the force levels normally encountered in the operation of the drawing-in machine 22, the pressing together of the balls 182 and 184 at the opening 180 in the inner end portion of the threading finger 40 serves to hold the threading finger 40 in the slot 179 of the head 60 of the reciprocable carrier 51. This holding action is such as to permit limited pivoting movement of the threading finger 40 in a vertical direction about the horizontal axis of the bore 185 for a purpose which will be described in greater detail below with reference to FIG. 4.

At higher force levels however, the threading finger 40 is readily removable from the slot 179, because a pull on the threading finger 40 will cause the spring pressed ball 184 to be shifted against the action of its spring 188 out of the hole 180 to permit bodily removal of the finger 40 in an axial direction. This releasable coupling of the threading finger 40 to the head 60 of the reciprocable carrier 51 assures that the machine will not develop forces that will damage the reed during movements of the threading finger 40. The arrangement also is advantageous in that it permits convenient replacement of one threading finger 40 with another of different size for accommodating different warp yarns and/or reeds of different pitches.

The vertical pivoting movement of the threading finger 40 about the horizontal axis of the bore 185 in the head 60 of the reciprocable carrier 51 is caused by the action of a machine operator in exerting tension upwardly on a warp yarn that has been engaged in the hook portion 42 at the end of the threading finger 40. In this connection it should be understood that the configuration of the drawing-in machine 22 leaves the top of the reed 2 substantially unobstructed, so that an operator standing at the front of the loom may lean over the reed 2 and rest his forearms on the top 18 of the reed. In this position, the operator can see the hook portion 42 of the threading finger clearly and use short hand and finger motions to manipulate the warp yarn ends with respect to the hook. In all, the demands on the operator are reduced to an entirely acceptable level and fatigue is not a serious problem.

A plunger 192 extends upwardly through an opening in the body of the machine 22 and has a head 194 on its lower end in position to be contacted by the top edge of the threading finger 40 as the threading is pivoted upwardly about the axis of the bore 185. See FIGS. 3 and 4. A part is threaded on the upper end 196 of the plunger 192 for fine adjustment and contacts a lever 198 and shifts the lever in a clockwise direction as viewed in FIG. 4 when the threading finger 40 is pivoted upwardly by the machine operator. The opposite end 200 of the lever 198 registers the movement in a switching component 202.

It is preferred that the circuits employed be such that the machine operator will have options with regard to how many upward movements of the threading finger 40 are required before a new cycle of operation of the drawing-in machine 22 will be initiated. For many reed threading operations, it will be desired to thread only one warp thread through each of the spaces between adjacent reed dents. In such an instance, it will be desirable to initiate a cycle of drawing-in machine operation upon the occurrence of each upward movement of the threading finger 40. However, in some instances, the operator may find it necessary to thread multiple warp yarn ends between the same reed spaces. The electronics used in the present invention can be adjusted to accommodate such operations by requiring that the desired multiple number of movements of the lever 200 be registered at 202 before a new cycle of drawing-in machine operation is initiated.

The plunger 192 is urged downwardly by spring means 204 bearing on the lever 198. Since different machine operators may be most comfortable with different yarn tension levels and since yarns of different sizes may themselves dictate that the operator employ different tension levels, it is preferred that the bias provided by the spring mean 204 be adjustable.

To this end, the upper portion of the spring means 204 abuts against a lever 206 pivoted at 208 and having its distal end portion 210 in position to be contacted from above by the lower end of a threaded abutment 212. This abutment 212 is readily adjustable in its position to change the bias provided by the spring 204.

The other switching functions associated with carrying out a cycle of drawing-in machine operation are initiated by the rods or pins 103 and 107 extending upwardly from the pivotable components 98 and 106 positioned in the path of the control roller 66 on the carrier 51 at the bottom of the machine. These extend upwardly through the bottom of the machine housing into positions such that their movements have effects on detectors located within the interior of the housing. One detector 214 is served by the pin 103. Another detector 216 is served by the pin 107. Both of these detectors are carried by a mount 218 positioned within the interior of the machine.

In a preferred form of the invention each of the detectors 214 and 216 is of a type in which a beam of radiation passes across a slot located in such a manner that the beam may be broken by movement of the corresponding rod 103 or 107. Pin 103 moves in and out with respect to a beam passing between portions 220 and 222 of the detector 214, for example.

The rod 103 will interrupt the beam of its detector 214 when the finger 98 is shifted by the control roller 66 out of the path of the control roller 66 as it moves about the axis of the shaft 120. It is preferred that the circuits be arranged so that this "arms" the switching circuit which then waits for the spring 104 to return the finger 98 to the position illustrated in FIG. 20. It is at this moment that the circuit changes the direction of rotation of the motor driving the shaft 120.

The function of changing the direction of motor rotation before the next machine cycle begins can be accomplished through the movement of the rod 107. Thus, the pivoting of switching element 106 by the roller 66 cause two control functions to take place. The motor 132 is shut off and the motor direction is "set" for the direction indicated in FIG. 17. This setting will be remembered when the next cycle is initiated. The arrangement is such that activation of the motor 132 can only be accomplished when the circuit has been "armed" by the action of the roller 66 on the switching finger 106, making this position the only entry point to the cycle. On the occasion of a machine start-up, the knob 139 may be rotated manually to bring the parts initially to this entry position for the motor-actuated cycle.

Although a particular embodiment of the invention has been illustrated and described in detail, variations and modifications will suggest themselves to persons of ordinary skill in the art. It is intended therefore that the foregoing be understood as exemplary and that the scope of the invention be ascertained from the following claims.

I claim:

1. A cyclically operable drawing-in machine for threading warp yarns through the spaces between adjacent dents of a loom reed, comprising frame means adapted to be mounted for movement lengthwise of a loom reed;

a drive screw mounted on said frame means for rotation about its longitudinal axis with its periphery exposed to extend along the reed in contact with the reed dents, said drive screw including a helical thread having at least several turns of cross-sections small enough to fit into the spaces between the side faces of adjacent dents of the reed so that portions of such turns may exert forces on the side faces of the reed dents to regulate the position of said frame relative to said reed; and means for controlling the angular position of said drive screw about its axis.

2. A drawing-in machine according to claim 1, wherein at least about ten turns of said thread are adapted to fit into the spaces between the side faces of the dents of the reed.

3. A drawing-in machine according to claim 2, wherein said drive screw is the only means for regulating the lengthwise position of said frame on the loom reed.

4. A drawing-in machine according to claim 1, wherein the pitch of said turns of said helical thread is substantially the same as the pitch of the dents of said reed, and wherein said means for controlling the angular position of said drive screw operates to cause rotation of said screw through an angle of 360 degrees during each cycle of machine operation to advance said frame along said reed a distance equal to the sum of the thickness of a reed dent and the width of a space between adjacent reed dents.

5. A drawing-in machine according to claim 1, including warp yarn threading means carried by said frame means at a location spaced vertically from said drive screw;

said threading means including a hook portion movable relative to said frame means from a front position in which it will be located in front of the reed, back through a space between adjacent reed dents to a rear position in which it will be located to the rear of the reed for receiving a warp yarn presented thereto, and then forwardly to said front position; and means for correlating movements of said hook portion with the control exerted over the angular position of said drive screw so that, in between cycles of machine operation, said hook portion is stationary in its rear position and said drive screw is stationary, and so that a machine cycle includes a forward movement of said hook portion to carry a warp yarn through a space between reed dents, continues with a predetermined rotary movement of said drive screw sufficient to advance said frame means along the reed a predetermined distance, and ends with a rearward movement of said hook portion through an adjacent space between reed dents to its rear position while said drive screw is stationary.

6. A drawing-in machine according to claim 5, wherein said hook portion of said threading means is additionally movable through a closed path beginning and ending at said front position and being located entirely in front of the reed, and wherein said movement correlating means causes said hook portion to be moved through said closed path during the rotary movement of said drive screw to displace the warp yarn end just drawn through a reed space well forward of said reed and allow disengagement thereof from said hook portion.

7. A drawing-in machine according to claim 5, wherein said threading means is a finger having said hook portion at a free end thereof, and wherein said movement correlating means comprises a turntable mounted on said frame means for rotation about a vertical axis generally parallel to the front of the reed, said turntable being movable relative to a control surface fixed on said frame means;

a carrier mounted on said turntable for bodily movement therewith and for radial reciprocating movement relative thereto, the end portion of said finger opposite said hook portion being connected to said carrier for movement therewith;

a gear rotatable about the axis of said turntable and being unattached with respect to said turntable and said carrier;

a rack fixed to said carrier and engaging said gear;

a control member on said carrier in position to contact said control surface; and means operable during each cycle of machine operation for first rotating said gear in a first direction while a portion of said control surface blocks movement of said control member about said gear axis to shift said rack with the carrier attached thereto in a forward direction far enough to free said control member from the blocking action of said control surface for swinging movement about said gear axis, then rotating said gear one complete revolution about said gear axis in said first direction to rotate said turntable through 360°, and then reversing the direction of rotation of said gear while again blocking movement of said control member about the gear axis to shift said rack with the carrier attached thereto in a rearward direction.

8. A drawing-in machine according to claim 7, wherein said means for controlling the angular position of said drive screw about its axis is coupled for rotation with said turntable so that said drive screw moves only when said turntable moves.

9. A drawing-in machine according to claim 8, wherein said control surface is formed by a wall having a generally circular portion and a radial protrusion therefrom, and wherein a pivotal element is biassed toward a position overlying an end portion of the path of said control element around said circular portion so that said pivotal element first is moved out of said path by said control element and then returned to said overlying position in which an end of said pivotal element blocks reverse movement of said control element around said circular portion of said wall, said return movement of said pivotal element causing reversal of the direction of rotation of said gear.

10. A drawing-in machine according to claim 5, wherein said helical thread includes as its trailing turn a portion of widened cross-section forming a continuation of the remainder of said thread so as to enter a reed dent space previously occupied by another turn of said thread during rotation of said drive screw, said portion of widened cross-section being thick enough to wedge the dent on the trailing side thereof rearwardly in an elastic bending movement to enlarge the dent space occupied thereby, said warp yarn threading means being in vertical alignment with said thread portion of widened cross-section so that said hook portion of said threading means may pass through said enlarged dent space.

11. A drawing-in machine according to claim 10, wherein the front face of said helical thread has a constant angle throughout and the widening of said trailing turn results from a divergence of the rear face of said thread from said front face.

12. A drawing-in machine according to claim 11, wherein the number of turns of said helical thread for entering reed dent spaces in front of said trailing turn is high enough to so distribute the forces reacting to the bending of said dent on the trailing side of said thread portion of widened cross-section that substantial bending of others of said dents is avoided.

13. A drawing-in machine according to claim 4, including a plurality of interchangeable drive screws of different pitches for replaceable mounting on said frame and coupling to said angular position controlling means.

14. A drawing-in machine according to claim 13, wherein all of said interchangeable drive screws are of substantially the same size and shape and wherein said frame means and said drive screws are provided with configurations assuring that the lead of a drive screw will have the intended direction when mounted on said frame means.

15. The combination of a loom having a reed with a drawing-in machine supported entirely by said reed, comprising means for mounting said drawing-in machine for free movement on the top of said reed;

screw means rotatable on said drawing-in machine and having a thread the pitch of which is substantially the same as the pitch of said dents in said reed, said thread including multiple turns which project into spaces between adjacent dents, one turn of said thread having a widened cross-section for temporarily enlarging the reed dent space occupied thereby;

means for rotating said screw means one revolution during a portion of each cycle of drawing-in machine operation and for holding said screw means stationary during another portion of each cycle of drawing-in machine operation; and warp yarn threading means in substantial alignment with said thread turn of widened cross-section and being projectable through said temporarily enlarged reed dent space while said screw means is held stationary.

16. A method of maintaining registry between a threading instrumentality in a drawing-in machine and the reed being threaded by said machine, comprising positioning a rotatable helical thread carried by said machine adjacent a face of the reed with portions of at least several of the turns of said thread protruding into spaces between adjacent reed dents; and controlling the angular position of said thread about its longitudinal axis so that, during a portion of a cycle of operation of the machine when the threading instrumentality is operable to thread a yarn through the reed, said helical thread is held against angular movement and, during another portion of the cycle, said helical thread is rotated through a predetermined angle to cause the machine to advance along the reed to position said threading instrumentality properly for a subsequent threading operation.

17. A method according to claim 16, wherein a trailing turn of said thread is gradually widened so that angular movement of said thread causes enlargement of a reed dent space by said widened thread portion to facilitate passage therethrough of said threading instrumentality.

18. A portable drawing-in machine adapted to be suspended on a loom reed having reed dents for bodily movement stepwise along the lengthwise direction of the reed and being operable in intervals between such movements to draw-in warp threads through the spaces between the reed dents, said machine comprising a body;

mounting means for removably supporting said body on a loom reed for lengthwise movement of said body in its entirety along such reed;

means for moving said body along such reed in steps of predetermined length related to the pitch of the reed dents and for holding said body against movement along said reed in intervals between such steps;

warp yarn threading means movable with said body lengthwise of the reed and having a portion which is projectable through the spaces between adjacent reed dents while said body is not moving lengthwise of the reed; and drive means for passing said portion of said threading means through a space between two reed dents to position said portion for receiving at least one warp yarn and thereafter moving said portion of said threading means back through said space to pull a portion of the received warp yarn through said space.

19. A portable drawing-in machine according to claim 18, wherein said mounting means suspends said machine body from the top of the reed with most of said body being located in front of and below the top of the reed and with the space above the reed being substantially unobstructed by said machine so that an operator standing at the front of the loom may lean across the top of the reed with forearms resting on the reed and hands in position to manipulate yarn ends which are to be threaded forwardly through the spaces between dents of the reed; and wherein said end portion of said threading means is a hook portion and said threading means is projectable rearwardly from said body to extend through a space between reed dents with said hook portion located behind and below the top of reed for receiving a yarn presented thereto by the operator.

20. A portable drawing-in machine according to claim 19, including cyclically operable motor means operably connected to said means for moving said machine body along the reed and to said drive means for said threading means, and wherein an upward force exerted on said hook portion of said threading means by tensioning a yarn engaged therewith causes initiation of a cycle of operation of said motor means.

21. A drive screw for cooperating with the dents of a loom reed to advance itself lengthwise along the reed and to open the space between a pair of adjacent dents as the screw is rotated, said screw comprising a first thread portion having a substantially constant pitch and a substantially constant width over at least several turns about the axis of the screw and a second thread portion forming a continuation of said first thread portion, said second thread portion having a widened cross-section 22. A drive screw according to claim 21, wherein said second thread portion has an extent not substantially greater than 360 degrees and wherein said second thread portion includes a front face directed toward said first thread portion and a rear face directed in the opposite direction, said front face having throughout a substantially constant thread angle corresponding substantially to the pitch of said first thread portion, and said rear face diverging from said front face in a direction away from said first thread portion to provide said widened cross-section.

* * * * *